United States Patent [19]

McCloud

[11] Patent Number: 5,058,892

[45] Date of Patent: Oct. 22, 1991

[54] TABLE SOCCER OR FUSSBALL GAME PLAYING BALL

[76] Inventor: Calvin E. McCloud, 4959 Rendon Rd., Fort Worth, Tex. 76140

[21] Appl. No.: 641,582

[22] Filed: Jan. 15, 1991

[51] Int. Cl.[5] ..... A63B 71/04; A63B 37/00

[52] U.S. Cl. ..... 273/128 A; 273/DIG. 8; 273/85 C; 273/58 A; 264/239

[58] Field of Search ..... 273/127 R, 127 A, 85 C, 273/85 D, 87 R, 87 B, 87.2, 87.4, 58 A, 128 R, 128 CS, 128 A, 60 B, 218, 235 R, DIG. 8

[56] References Cited

U.S. PATENT DOCUMENTS

| | | | |
|---|---|---|---|
| 1,686,124 | 10/1928 | Brower | 273/128 A |
| 2,524,546 | 10/1950 | Sinclaire | 273/128 A |
| 3,518,786 | 7/1970 | Holtvoigt | 273/58 A |
| 4,274,637 | 6/1981 | Molitor | 273/235 R |
| 4,610,071 | 9/1986 | Miller | 273/60 B X |
| 4,790,534 | 12/1988 | Jamison | 273/87.2 |
| 4,861,028 | 8/1989 | Williams | 273/60 B |

*Primary Examiner*—George J. Mario
*Attorney, Agent, or Firm*—Johnson & Gibbs

[57] ABSTRACT

A substantially improved table soccer/fussball game playing ball is fabricated by molding an oversized spherical blank entirely from a single thermoplastic material, preferably a urethane material having a hardness within the approximate range of from about 50 Shore D to about 60 Shore D. The oversized molded blank is then subjected to a precision surface machining process, preferably using a centerless grinding machine, to reduce its diameter to a desired finished magnitude and to provide the resulting finished playing ball with a very precisely spherical shape. Compared to conventionally fabricated table soccer playing balls, the machined, single thermoplastic material playing ball provides a variety of advantages including a truer playing roll, considerably more durability and resistance to surface wear, and the desirable ability to retain its "like-new" playing characteristics for a much longer period of time.

2 Claims, 1 Drawing Sheet

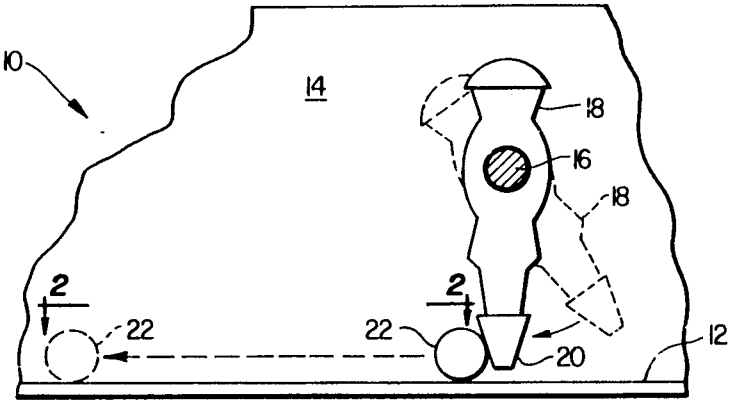
FIG. 1
(PRIOR ART)
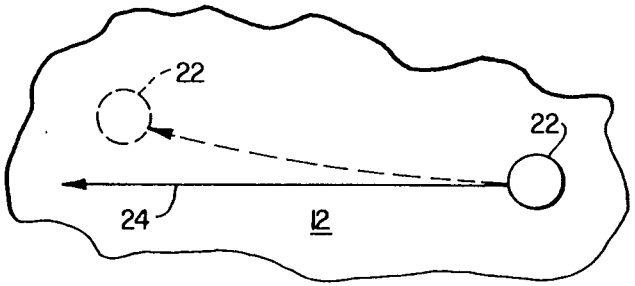
FIG. 2
(PRIOR ART)
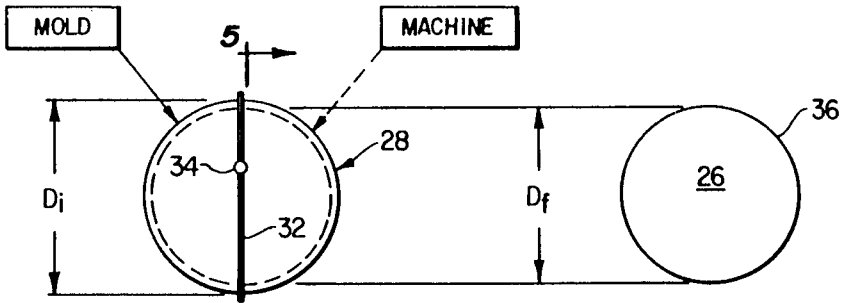
FIG. 3
FIG. 4
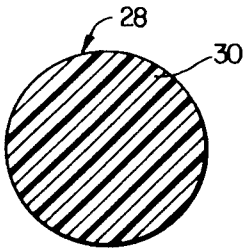
FIG. 5

TABLE SOCCER OR FUSSBALL GAME PLAYING BALL

BACKGROUND OF THE INVENTION

1. Field of the Invention

The present invention relates generally to table soccer or fussball game apparatus, and more particularly relates to the fabrication of playing balls used in table soccer or fussball games.

2. History of the Prior Art

A table soccer or fussball game typically comprises an elevated, open-topped elongated rectangular table structure having a bottom wall with a playing surface formed on its top side. The playing surface is peripherally bounded by an opposite pair of upstanding table end walls and an opposite pair of upstanding table side walls. Spaced apart along the length of the table are a series of elongated, parallel actuating rods which extend transversely to the length of the playing surface and are elevated with respect thereto. The opposite ends of each rod are received in and extend through an opposite pair of side wall bearing structures which permit the rod to be rotated and/or axially translated relative to the playing surface.

Molded plastic playing figures are suitably anchored to the actuating rods for rotation and axial translation with their associated rod, and are provided at their lower ends with specially configured foot portions. With a playing figure in its upright vertical position its foot portion is positioned somewhat above the playing surface, whereby each of the playing figures may be rotated through a full 180° arc if desired.

For each player, the object of the game is to use his playing figure foot portions to rollingly propel a playing ball lengthwise along the playing surface, past the opponent's playing figures and into the opponent's goal area at a end of the playing surface. Such lengthwise movement of the ball along the playing surface (using a basic shot technique) is accomplished by appropriately aligning a playing figure with the ball and then rotating the playing figure to bring its foot portion sharply into contact with the ball. Other shot techniques may be utilized, and the ball may be laterally "passed" from one playing figure to another using their foot portions.

As played by skilled and experienced players, the game of table soccer or fussball is one of considerable intricacy and precision, with ball control accuracy being of paramount importance. In an effort to provide and maintain the ability to precisely control ball shooting and passing accuracy, considerable design effort has been expended over the years to improve the structural precision, longevity and playing consistency of various table soccer/fussball game components such as the playing surface, the rod bearing structures, the playing figures and their critical foot portions, and resilient side bumper structures used to protect the outermost playing figures on each actuating rod.

However, surprisingly few changes have been made over the years to a critical element of ball control accuracy-the playing ball itself. Accordingly, the playing ball is now generally seen to be one of the weaker links in the overall structural game component chain which must cooperate to provide optimum playing accuracy and consistency.

Typical table soccer/fussball game playing balls now in use are conventionally molded, generally to their finished spherical size, utilizing a blend of different thermoplastic materials-typically a relatively "hard" first thermoplastic material and a relatively "soft" second thermoplastic material. Under conventional design theory, this blending of different thermoplastic materials has heretofore been deemed necessary in order to provide the finished playing balls with a desirable combination of resiliency and mechanical toughness, along with other physical characteristics, which neither of the individual thermoplastic materials could provide by itself. After molding, the conventional dual material playing balls are subjected to a surface finishing tumbling process, to remove the usual molding flash and gate projections therefrom, thereby readying the balls for play. Alternatively, conventional table soccer/fussball game playing balls are molded from a single thermoplastic material to which a foaming agent is added in an effort to reduce the sphericity deviations caused by non-uniform cooling shrinkage associated with the molding process.

Despite the wide acceptance of these conventional playing ball fabrication methods, the playing balls resulting therefrom are subject to a variety of well known, and heretofore unavoidable, problems, limitations and disadvantages. For example, the normal nonuniform cooling shrinkage problem associated with plastic molding processes in general tends to be aggravated, via cross-contamination, by the use of two different thermoplastic materials in the molded balls. The finished balls are thus, to varying degrees, out-of-round to an extent such that they undesirably tend to stray from their intended shot or passing paths along the playing surface.

In the case where the ball is molded from a thermoplastic material to which a foaming agent has been added, the resulting out-of-roundness is somewhat reduced but still exists to an extent causing the ball to stray from its intended roll path. Additionally, the presence in the molded ball of the previously added foaming agent tends to significantly degrade the desired physical and playing characteristics of the ball.

During the initial portion of the playing life of a given ball fabricated by either of these conventional techniques, its tendency to stray from its intended roll path is somewhat lessened by the roughened exterior surface thereon, created during tumbling of the ball, which helps the ball to grip the playing surface and somewhat ameliorate the trueness of the ball's rolling path along the playing surface. However, this beneficial effect of the roughened surface quickly dissipates as the roughness is relatively rapidly worn away during play.

Conventionally fabricated playing balls of these types are also undesirably subject to two types of inconsistency. First, there tends to be inconsistencies in both physical and playing characteristics from one mold "batch" of balls to another (and often shot-to-shot inconsistences as well). Accordingly, it is a frequent occurrence for one ball to "play" markedly differently from another ball, whether the two balls are from the same mold batch or from different mold batches.

The second type of inconsistency is the often marked variation of playing characteristics of a given ball during its playing life. Simply stated, conventionally fabricated playing balls do not retain their "like new" playing characteristics for very long.

Another well known disadvantage of conventionally fabricated table soccer/fussball game playing balls is that they tend to wear out with surprising rapidity, particularly during strenuous play, and must be frequently replaced. Despite attempts, for example through the blending of different thermoplastic materials, to forestall such wearout, conventionally fabricated playing balls are quite susceptible to surface abrasion and gouging which diminishes their playing lives and aggravates their already undesirable rolling eccentricities.

It can readily be seen from the foregoing that it would be highly desirable to eliminate, or at least substantially reduce, the above-mentioned problems, limitations and disadvantages heretofore associated with conventionally fabricated table soccer/fussball game playing balls, and it is accordingly an object of the present invention to do so.

SUMMARY OF THE INVENTION

In carrying out principles of the present invention, in accordance with a preferred embodiment thereof, a substantially improved table soccer/fussball game playing ball is formed utilizing a unique combination of fabrication steps. First, a diametrically oversized spherical playing ball blank is molded entirely from a single thermoplastic material (i.e., without the addition thereto of a foaming agent or a second thermoplastic material), preferably a urethane material having a hardness approximately within the range of from about 50 Shore D to about 60 Shore D. To complete the improved playing ball the oversized blank is precision machined, preferably using a centerless grinding machine, to reduce its diameter to that desired for the finished playing ball and to provide the finished playing ball with a very precisely spherical shape and a relatively smooth, unroughened exterior surface.

The use of a single thermoplastic material, and nothing else, to form the improved playing ball eliminates the molding contamination problems associated with conventional molded game balls formed from a blend of different thermoplastic materials or one thermoplastic material to which a foaming agent has been added. Accordingly, improved balls formed by the method of the present invention are much more uniform in their physical and playing characteristics. Additionally, they are considerably more resistant to playing wear and maintain their "like new" playing characteristics for a far grater time. Moreover, the precision machining of the oversized ball blanks provides the finished balls with a truer "roll" along the game playing surface, thereby providing for significantly enhanced playing accuracy and uniformity.

BRIEF DESCRIPTION OF THE DRAWINGS

For a more complete understanding of the present invention and for further objects and advantages thereof reference may now be had to the following description taken in conjunction with the accompanying drawings in which:

FIG. 1 (PRIOR ART) is a simplified partial cross-sectional view through a representative table soccer game structure in Which a conventional game ball is being rollingly propelled along the game playing surface after being struck by a pivotally mounted playing figure;

FIG. 2 (PRIOR ART) is a top plan view of the conventional ball illustrating, at an exaggerated scale, its tendency to undesirably deviate from its intended propulsion path due to fabrication inaccuracies therein;

FIG. 3 is a side elevational view of an oversized molded spherical blank used to form an improved playing ball of the present invention, and schematically depicts the molding of the blank and a finish machining step used to convert the molded blank to a finished playing ball;

FIG. 4 is a side elevational view of a finished playing ball resulting from the fabricational steps schematically depicted in FIG. 3; and FIG. 5 is a cross-sectional view through the molded blank taken along line 5—5 of FIG. 3.

DETAILED DESCRIPTION

Cross-sectionally illustrated in FIG. 1 is a portion of a conventional table soccer of fussball game structure 10 which includes a horizontal playing surface 12 that forms the bottom side of an elevated table structure bounded at its left and right ends by a pair of upstanding end walls (not shown), and bounded on its opposite sides by a pair of upstanding sidewalls 14, only one of which if visible in FIG. A series of laterally spaced apart actuating rods 16 (only one of which is shown in FIG. 1) have opposite end portions thereof received in suitable bearing structures in the opposite sidewalls 14 and are rotatable and axially translatable relative to the sidewalls. Molded plastic playing figures, such as the playing figure 18 in FIG. 1, are anchored to the actuating rod 16 for rotation and axial translation therewith, and are provided at their lower ends with a specially configured foot portion 20.

The object of the game is to utilize a foot portion 20 to rollingly propel a playing ball 22 along the playing surface 12 and into an opponent's goal area disposed at one end of the table. During play, this is effected by appropriately aligning the playing figure 18 with the ball 22, pivoting the playing figure to a vertically canted position such as the dotted line position shown in FIG. and then sharply pivoting the playing figure to the generally vertical, solid line position to sharply strike the ball 22 with the playing figure foot portion 20, thereby leftwardly propelling the ball 22 toward its dotted line position.

Due to various fabricational inaccuracies therein, conventional playing balls such as the illustrated ball 22, are out-of-round to an extent such that (as schematically illustrated in FIG. 2) they tend to undesirably stray from their intended shot path 24 as they are rollingly propelled, as just described, along the playing surface 12. This tendency to stray from the intended shot path (or a foot-to-foot passing path) is aggravated in a relatively short time after the conventional ball 22 is put into play. Accordingly, it is a quite common characteristic of conventionally fabricated table soccer/fussball game playing balls that they must be very frequently replaced.

As has been conventional for quite some time, the illustrated playing ball 22 is fabricated by molding the ball to an essentially finished, generally spherical size utilizing a blend of different thermoplastic materials-typically one relatively "hard" thermoplastic material and a considerably "softer" second thermoplastic material. The conventional design wisdom behind molding the ball 22 from a blend of different thermoplastic materials is grounded in the traditional belief that such blending is necessary to provide the finished ball 22 with the dual characteristics of toughness and resiliency (together with other physical attributes) at levels intended to optimize the playing characteristics of the ball. Alternatively, conventional table soccer/fussball game playing balls are molded from a single thermoplastic material to which a foaming agent is added in an effort to reduce the sphericity deviations caused by non-uniform cooling shrinkage associated with the molding process.

After the conventional ball 22 is molded essentially to its finished size, its exterior surface has thereon the usual flash and gate projections associated with the plastic molding process. To remove these projections, the molded playing balls are subjected to a surface finishing tumbling process which provides the finished balls with somewhat roughened exterior surfaces.

Playing balls fabricated by the above-described conventional processes are usually out-of-round to an extent that, even when brand new, they typically exhibit at least some tendency to stray from their intended shot or passing paths as representatively shown in FIG. 2, or are otherwise lacking in the physical characteristics necessary to optimize their suitability as table soccer/-fussball game balls. This undesirable sphericity deviation and/or physical characteristics unsuitability is caused by the usual non-uniform cooling shrinkage typically associated with plastic molding processes in general, and aggravated by the cross-contamination of the different thermoplastic materials used to form the molded ball 22, or by the unavoidable interaction between the single material and its required foaming agent additive. The surface finishing tumbling process used to remove the flash and gate projections does little to correct the sphericity deviations in the finished playing balls, and such sphericity deviations and other physical characteristic flaws arising from the two ball materials, or the ball material/foaming agent interaction, have been heretofore thought to be a necessary price to be paid for providing the balls with some modicum of both toughness and resiliency.

The roughened exterior ball surfaces created by the tumbling process do provide the conventionally fabricated playing balls with one beneficial feature-namely, the enhancement of the frictional grip of the balls on the playing surface. This feature tends to improve the rolling trueness of the balls and has been traditionally relied upon to compensate for their unavoidable out-of-roundness. However, this frictional gripping capability of the playing balls quickly -dissipates after the particular ball has been in play for just a relatively short time.

The aforementioned conventional fabrication techniques tend to undesirably provide different batches of playing balls with markedly different physical and playing characteristics. The ball-to-ball "play" characteristics are thus prone to often substantial differences which are at least an annoyance to skilled players. The playing characteristics of a given conventionally fabricated playing ball also tend to vary quite noticeably during the useful life of the ball. Conventional playing balls are also surprisingly susceptible to surface damage and wear. This tendency to wear quite rapidly typically requires that conventionally fabricated playing balls be replaced quite frequently.

Turning now to FIGS. 3–5, the present invention provides a substantially improved table soccer/fussball game playing ball 26 (FIG. 4) which, compared to the conventionally fabricated playing ball 22, offers a variety of desirable advantages. The improved playing ball 26 is formed by a unique combination of fabrication steps which will no be described.

The initial step in fabricating the improved playing ball 26 is, as schematically depicted in FIG. 3, to mold a diametrically oversized playing ball blank 28 entirely from a single thermoplastic material 30 (FIG. 5) which is preferably a thermoplastic urethane material having a hardness within the approximate range of from about 50 Shore D (durometer) to about 60 Shore D (durometer). It has been found that a particularly suitable urethane material for this application is that marketed under the trade name TEXIN 455-D by the Mobay Corporation. This particular material is a polyester-based polyurethane material having a hardness of approximately 55 Shore D.

As illustrated in FIGS. 3 and 4, the blank 28 has an initial diameter $D_i$ which is slightly larger than the desired diameter $D_f$ of the finished playing ball 26, and has the usual flash and gate projections 32, 34 thereon. The finished playing ball 26 is formed from the diametrically oversized, generally spherical blank 28 by precision machining the exterior of the surface blank 28, preferably utilizing a centerless grinding machine, to remove the flash and gate projections 32 and 34, to reduce the diameter of the blank 28 from $D_i$ to $D_f$, and to provide the resulting playing ball 28 with a precise sphericity which does not vary by more than about 0.001" on any exterior surface portion thereof, and a relatively smooth exterior surface 36.

The unique combination of the single thermoplastic material (without other materials or foaming agents) and the precision surface machining used to fabricate the playing ball 26 has been found to provide it, compared to the conventionally fabricated ball 22, with improved rolling trueness and considerably greater batch-to-batch consistency in its physical and playing characteristics. The improved ball 26 is also far more durable and resistent to surface wear, thus providing it with a greatly extended playing life. Moreover, the playing characteristics of a given ball 26 have been found to remain generally constant (i.e., it retains its "like new" playing characteristics) over a considerable portion of its significantly extended playing life. It can thus be seen that the table soccer or fussball game playing ball 26 of the present invention represents a significant advancement over conventional playing balls such as the ball 22.

It is thus believed that the operation and construction of the present invention will be apparent from the foregoing description. While the method and apparatus shown or described has been characterized as being preferred, it will be obvious that various changes and modifications may be made therein without departing from the spirit and scope of the invention as defined in the following claims.

What is claimed is:

1. A table soccer or fussball game playing ball for use of a horizontal soccer or fussball game playing surface, said ball being made entirely from a single thermoplastic urethane material having a hardness within the range of from about 50 Shore D to about 60 Shore D, said playing ball having a smooth, machined outer surface, and a sphericity which does not vary by more than about 0.001" on any external surface portion thereon, to thereby enhance the trueness of roll of said ball along said table soccer or fussball playing surface.

2. The table soccer or fussball game playing ball of claim 1 wherein said playing ball is molded from a single polyester-based thermoplastic polyurethane material having a Shore D hardness of approximately 55.

* * * * *